US005409383A

United States Patent [19]

Mannino

[11] Patent Number: 5,409,383

[45] Date of Patent: Apr. 25, 1995

[54] MULTI-FUNCTIONAL WRITING DEVICE

[76] Inventor: Thomas C. Mannino, 25575 Rutledge Crossing, Farmington Hills, Mich. 48335

[21] Appl. No.: 137,372

[22] Filed: Oct. 14, 1993

Related U.S. Application Data

[63] Continuation of Ser. No. 21,315, Feb. 23, 1993, abandoned.

[51] Int. Cl.[6] ..... B43L 1/00

[52] U.S. Cl. ..... 434/414; 434/408; 434/413; 434/415; 434/88

[58] Field of Search ..... 434/85, 88, 408, 409, 434/413, 414, 415, 419

[56] References Cited

U.S. PATENT DOCUMENTS

| | | | |
|---|---|---|---|
| 177,892 | 5/1876 | Slade | 434/413 |
| 183,157 | 10/1876 | Haggerty . | |
| 205,582 | 7/1878 | Shepherd | 434/413 X |
| 226,319 | 4/1880 | Jewell | 434/415 |
| 365,182 | 6/1887 | Heyer | 434/414 |
| 415,371 | 11/1889 | Smith | 434/413 X |
| 2,791,040 | 5/1957 | Santorelli . | |
| 3,333,912 | 8/1967 | Kunz et al. | 434/419 X |
| 4,003,579 | 1/1977 | Miscavage | 273/148 R |
| 4,427,391 | 1/1984 | Berman | 434/408 |
| 4,604,062 | 8/1986 | Woods | 434/88 |
| 5,035,626 | 7/1991 | Persing | 434/408 |
| 5,163,845 | 11/1992 | Blassingame | 434/408 |
| 5,203,702 | 4/1993 | Wilson | 434/85 |

FOREIGN PATENT DOCUMENTS

| | | | |
|---|---|---|---|
| 536129 | 1/1957 | Canada | 434/408 |
| 975414 | 10/1950 | France | 434/415 |
| 1206548 | 8/1959 | France | 434/430 |
| 651689 | 9/1985 | Switzerland | 434/88 |
| 2214137 | 8/1989 | United Kingdom | 434/409 |

*Primary Examiner*—John G. Weiss
*Assistant Examiner*—Jeffrey A. Smith
*Attorney, Agent, or Firm*—Howard & Howard

[57] ABSTRACT

A writing device is disclosed wherein a clear overlay is pivotally attached to an underlying enclosure. A support surface is formed on the enclosure beneath the clear overlay. Paper forms may be placed on the support surface such that one may write on the clear overlay, using the written guide to trace. In another feature, the support surface is provided by a secondary writing surface that may be selectively positioned on the overlay. The secondary writing surface upon removal is dimensioned to be accepted within a well-like enclosure formed by the frame for the clear overlay. The secondary writing surface is erasable, may be formed of a porcelainized wallboard, and additionally may be magnetized. Alternatively, a chalkboard may be utilized for the secondary writing surface. The overlay is preferably formed of a non-porous coated plexiglass to make it being easily erasable. In addition, the overlay may be attached to the enclosure through a removable hinge such that it may be removed for cleaning. In additional features, a protective storage cover is placed over the overlay by a hook and loop-type fastener. Also, a drawer may be formed in the enclosure.

20 Claims, 2 Drawing Sheets

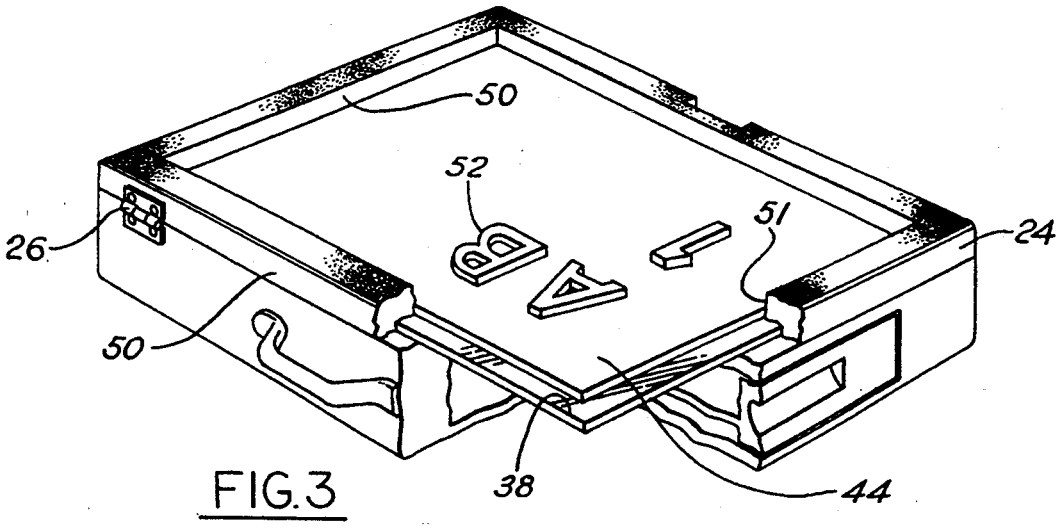
FIG.3
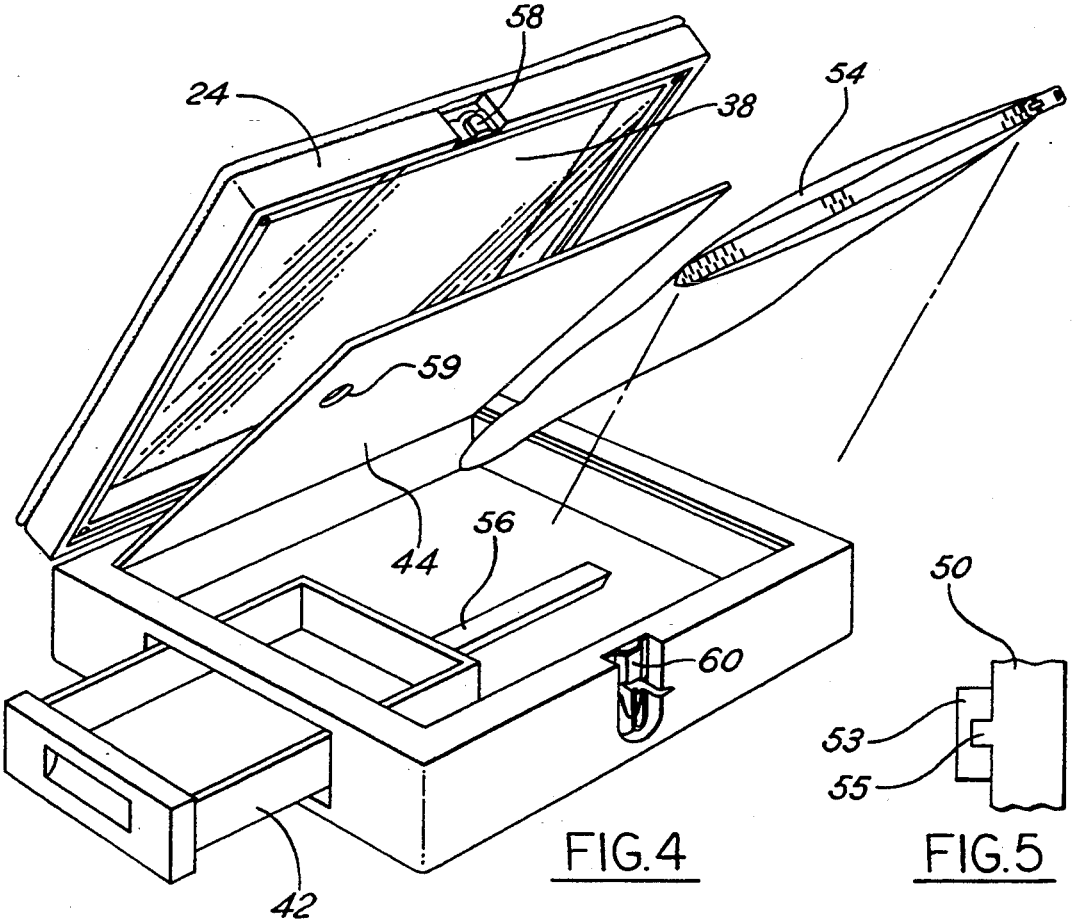
FIG.4
FIG.5

MULTI-FUNCTIONAL WRITING DEVICE

This is a continuation of application Ser. No. 08/021,315 filed on Feb. 23, 1993 (abandoned).

BACKGROUND OF THE INVENTION

This application in general relates to a writing device that is extremely versatile when compared with prior art devices.

In the prior art, devices are known wherein a clear overlay is placed over an underlying paper form. One then writes on the clear overlay, using the paper form as a copy guide. The clear overlay may then be erased, and the paper form may be reused. These devices are particularly useful for a writing device for children, since children tend to write or draw for long periods of time, and would require large numbers of the paper forms if they wrote on the paper forms. The prior art devices, however, have not been easy to utilize, nor have they been very versatile.

SUMMARY OF THE INVENTION

In a disclosed embodiment of the present invention, a clear overlay is pivotally connected to an enclosure, such that the clear overlay may be pivoted away from a support surface on the enclosure to provide access to the paper form. The enclosure is self-supported and thus provides portability for the device. The paper form may then be easily changed, to allow the use of a different paper form. Moreover, the enclosure preferably includes a secondary writing surface that provide the support surface for the paper guide. The improved writing device thus provides increased versatility in that the secondary writing surface may be removed easily from the enclosure and placed above the clear overlay such that one may write on the secondary writing surface. In the preferred embodiment of the present invention the clear overlay is provided by a clear surface that allows one to simply wipe-off any writing, surrounded by a molded plastic frame. The frame provides a recessed, well-like space above the clear overlay. The secondary writing surface is dimensioned to be received within that recess such that it is securely positioned on the enclosure.

In other features of the present invention the secondary surface may be porcelainized enamel wallboard such that it may be easily erasable. Moreover, the secondary surface could be magnetized. The secondary surface could also be a chalkboard, rather than the porcelainized surface. In a most preferred embodiment the two faces of the secondary writing surface could have different properties. As an example, one side could be porcelainized wallboard and the other side magnetized or a chalkboard. The clear overlay is preferably formed of a plexiglass.

In other features, the pivotally connected clear overlay may be attached to the enclosure through removable hinges such that one may paint on the clear overlay, and snap it away from the enclosure for easy cleaning. The overlay may also be washable on the enclosure with warm soap and water or a damp cloth. In other features, a recessed draw catch latch is formed on a portion of the enclosure opposed to the hinges. One may rest the enclosure on its end, with the latch not providing any obstruction to such positioning. A handle is used adjacent the hinge such that the device can be transported like a briefcase.

In another feature of the present invention, a cover is placed over the clear overlay to protect the clear surface. Preferably, the frame of the clean overlay has the loop portion of a hook and loop-type fastener. The loop portion would not be abrasive to the touch, and thus it is preferably used on this portion of the enclosure. The cover preferably has the hook portion of the hook and loop-type fastener, and is selectively attached to the enclosure to protect the clear overlay. The cover is preferably a bag that can hold the paper forms, writing implements, or other items. Thus, a user of the writing device has easy access to such items. In addition, a drawer may be selectively moved within a side of the enclosure to provide access to items stored within the enclosure, without the requirement of opening the enclosure. Thus, should one be working on a particular drawing, and desire an item from the interior of the enclosure, the drawer would provide access to that interior without removing the secondary writing surface or the paper form.

These and other features of the present invention can be best understood from the following specification and drawings, of which the following is a brief description.

BRIEF DESCRIPTION OF THE DRAWINGS

FIG. 3 is a view similar to FIG. 2, but showing additional cutaway portions.

FIG. 4 is a perspective view of the invention showing the interior of the enclosure.

FIG. 5 is a detailed cross-sectional view of a hinge that may be incorporated into the present invention.

DETAILED DESCRIPTION OF THE PREFERRED EMBODIMENT

Figure 1:
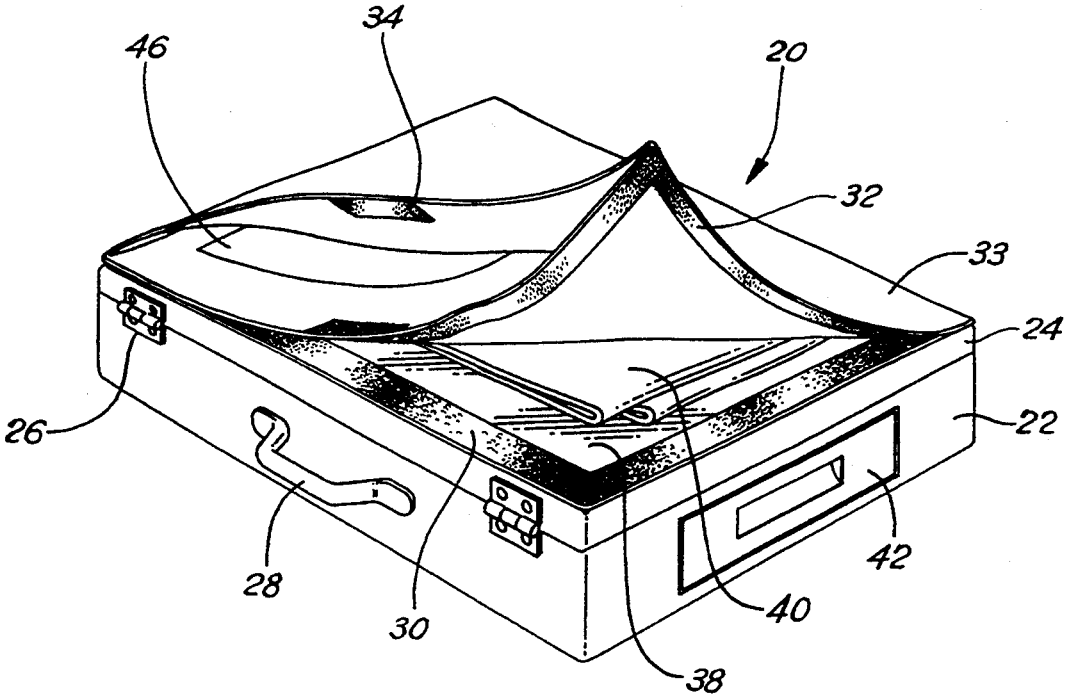
FIG. 1 is a perspective view of an embodiment of the present invention.

FIG. 1 shows writing device 20 having an enclosure defined by a base 22 and a top 24 which is attached to base 22 at hinges 26. A handle 28 is formed on base 22 at one end. A loop surface 30 of a hook and loop-type fastener is formed around the outer periphery of top 24. Loop surface 30 is selectively connected to hook portions 32 formed on an envelope-like cover 33 selectively positioned over top 24. A hook and loop-type closure 34 is on the envelope to close the interior 36. Materials thus may be stored within cover 33. A clear overlay surface 38 is formed as a portion of top 24. As shown, a cloth 40 may be stored between cover 33 and clear overlay 38. Clear overlay 38 is preferably formed of an easily erasable plexiglass. One known preferred plexiglass is available under the trade name Marguard TM which has a desirably coated non-porous surface. Any markers, pens or pencils which are erasable from the overlay surface are preferably utilized. Specifically, dry-erase markers or poster board paints are envisioned. In addition, a drawer 42 may preferably be formed in a side of base 22. Hinge 26 may include a stop limiting movement beyond a certain angle (i.e. 100 degrees). Additionally the hinge may be spring loaded to open once the latch is disengaged. In this way the top would not slam on fingers. Alternatively, an arm may support the top 24. A marker may be provided with a hook fastener portion such that it may be held on the portion 30 when not in use.

Figure 2:
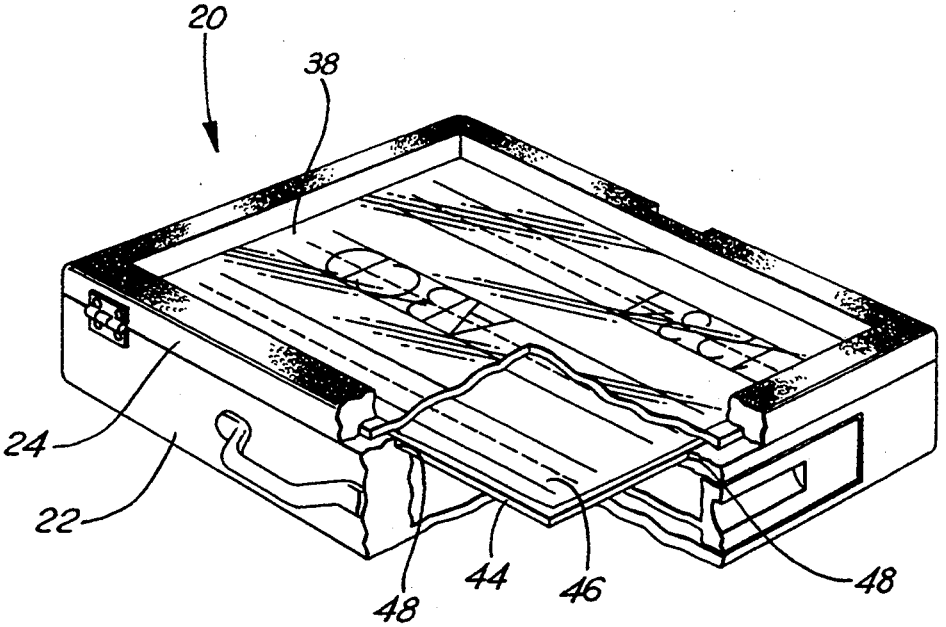
FIG. 2 is a view similar to FIG. 1, but showing portions of the invention in cutaway sections.

As shown in FIG. 2, clear overlay 38 overlies paper forms 46 which rest on a secondary writing surface 44.

Secondary writing surface 44 rests on a ledge 48 that is defined on the base 22. The ledge is typically formed as a dado on the enclosure. Thus, one may pivot top 24 away from base 22, and change the paper form 46 supported on secondary writing surface 44. Also, one could use writing on the secondary writing surface as the guide. As can be seen, clear overlay 38 allows one to read the paper form 46, and use indicia from that form to guide one's writing. It is envisioned that this device will be particularly useful to allow one to complete blanks on the guides (i.e. crossword puzzles, lesson plans, etc.) Since the top 24 is pivotally attached to base 22 there is easy access for changing the paper form. In the prior art, such devices have typically required one to remove the top entirely, or alternatively to slide the writing form between the top and the support portion. This may be particularly burdensome to a young child.

As shown in FIG. 3, secondary writing surface 44 may be selectively positioned on clear overlay 38. As shown, top 24 consists of a frame 50, preferably molded from plastic, surrounding clear overlay 38. A well 51 is formed between the frame 50 and clear overlay 38. Secondary writing surface 44 is dimensioned to fit within well 51, which holds it securely on top 24. The secondary writing surface is closely dimensioned to the size of both the ledge and the well such that it is securely held without substantial movement even when the device is positioned on an angle relative to the horizontal. This increases the versatility of the device. As shown, secondary writing surface 44 may be magnetized to receive magnetic items 52. Secondary writing surface 44 is also preferably porcelainized enamel wallboard that is erasable when used with so-called dry markers. As a further alternative, secondary writing surface 44 could be a chalkboard.

Thus, a user of writing device 20 has the option of utilizing clear overlay 38 with an underlying paper form, or alternatively placing the secondary writing surface 44 on top of the clear overlay. One thus has great versatility in the type of writing, drawing or other activities performed with the device 20.

As shown in FIG. 4, top 24 pivots away from base 22. Secondary writing surface 44 is easily removable, and a finger hole 59 may facilitate removal. Drawer 42 slides on a rail 56. A bag 54 may be positioned within the base 22 and may store various items. The enclosure also provides storage space.

A latch 58, 60 is recessed in an end of top 24 and base 22, respectively. Thus, one may position the writing device 20 on the side which includes the latch, and it will stand on that side. This increases the versatility to transport and use the device. A child could carry the device like a school briefcase.

As shown in FIG. 5, a removable hinge 53 may replace hinge 26. As an example, a snap 55 may secure hinge 53 to frame 50 of top 24. By snapping off the snap, one may thus remove the entire top 24. This would be valuable if the clear overlay was used as a painting surface. One could thus snap the top completely off for cleaning.

In further features a light could be included in the enclosure to provide a backlit light box. Also, a light may be clipped outside the enclosure on the lid to provide an overhead light. In such an application the secondary writing surface may be somewhat translucent. The hook and loop portions could be molded into the molded top.

In summary, an improved writing device is disclosed wherein the use of the writing board is simplified, and its versatility is increased. Although a preferred embodiment of the present invention has been disclosed, a worker of ordinary skill in the art would recognize that certain modifications would come within the scope of this invention. For that reason the following claims should be studied in order to determine the true scope and content of this invention.

I claim:

1. A writing device comprising:

a clear overlay;

said overlay being positioned above an enclosure, said enclosure including a secondary writing surface providing a support surface beneath said overlay such that guides may be placed on said support surface and beneath said overlay; and said secondary writing surface being supported on a ledge on said enclosure, said overlay being formed by a frame positioned around a transparent surface, both said ledge and said frame each define a portion of a well-like enclosure to receive said secondary writing surface.

2. A writing device as recited in claim 1, the portion of said well-like enclosure defined by said ledge and the portion of said well-like enclosure defined by said frame have approximately the same dimensions, and both closely receive said second writing surface.

3. A writing device comprising:

a clear overlay;

an enclosure providing a support surface beneath said overlay, said overlay being pivotally attached to said enclosure, such that a form may be placed on said support surface beneath said overlay, and one may write on said overlay using said form as a guide, and said overlay may be pivoted away from said enclosure to allow changing of said form; and wherein a hook-and-loop-type fastener selectively attaches a protective cover to said overlay.

4. A writing device as recited in claim 3, where writing implements are provided with hook and loop-type fastener portions such that they may be held on said clear overlay when not in use.

5. A writing device as recited in claim 3, wherein said protective cover is a bag that is selectively opened and closed to hold items.

6. A writing device comprising:

a clear overlay, formed of a material such that it may be easily cleaned by wiping, said overly being formed of a plexiglass, and said plexiglass having a non-porous coating to facilitate the wipe-off cleaning:

an enclosure providing a support surface beneath said overly, said overlay being pivotally attached to said enclosure such that a form may be placed on said support surface beneath said overlay, and one may write on said overlay using said form as a guide, and said overlay may be pivoted away from said enclosure to allow changing of said form, said enclosure providing a space for storage of said form when said form is not on said support surface.

7. A writing device as recited in claim 6, wherein said space is beneath said support surface.

8. A writing device as recited in claim 6, wherein said support surface provides a writing surface formed of a porcelainized enamel wallboard.

9. A writing device as recited in claim 6, wherein said support surface provides a secondary writing surface which is a chalkboard.

10. A writing device as recited in claim 6, wherein said support surface provide a secondary writing surface which is magnetized.

11. A writing device as recited in claim 6, wherein said support surface provides a secondary writing surface which has different properties on its two faces.

12. A writing device as recited in claim 6, wherein said overlay is provided by a transparent member received within an outer frame, a well being defined below said overlay within said frame, and said said support surface provides a secondary writing surface being dimensioned to fit within said well.

13. A writing device as recited in claim 12, wherein said secondary writing surface is supported on a ledge of said enclosure, said ledge defining a well-like space approximately of the same dimension as said well defined by said overlay.

14. A writing device as recited in claim 6, wherein a drawer is formed in said enclosure.

15. A writing device as recited in claim 6, wherein said overlay is attached to said enclosure by a removable hinge such that said overlay is removable from said enclosure.

16. A writing device as recited in claim 6, wherein a latch is disposed on said enclosure and said transparent overlay, said latch being recessed such that said writing device may be positioned on the end that receives said latch.

17. A writing device as recited in claim 16, wherein a handle is provided opposite the latch such that the device may be transported like a briefcase.

18. A writing device comprising:

a clear overlay;

a support surface beneath said overlay, and a frame surrounding said support surface, said overlay being pivotally attached to said frame, such that a form may be placed on said support surface beneath said overlay, and one may write on said overlay using said form as a guide, and said overlay may be pivoted away from said frame to allow cleaning of said form, said overlay being connected by a hinge to said frame, and said hinge being attached to one of said overlay and said frame by a force-fit connection such that said overlay may be easily removed from said frame for cleaning.

19. A writing device as recited in claim 18, wherein said force-fit connection is a snap connection.

20. A writing device as recited in claim 19, wherein said hinge consists of two parts connected by a hinge connection, with a first of said two parts connected to said frame, and a second of said two parts connected by said snap to said overlay.

* * * * *